US007055919B2

(12) United States Patent
Lam Harn et al.

(10) Patent No.: US 7,055,919 B2
(45) Date of Patent: Jun. 6, 2006

(54) DRAWER FITTING ARRANGEMENT

(75) Inventors: Lian Lam Harn, Perak (MY); Yan Lam Harn, Perak (MY)

(73) Assignee: Harn Marketing Sdn Bhd, Perak (MY)

( * ) Notice: Subject to any disclaimer, the term of this patent is extended or adjusted under 35 U.S.C. 154(b) by 148 days.

(21) Appl. No.: 10/440,424

(22) Filed: May 19, 2003

(65) Prior Publication Data

US 2004/0000849 A1 Jan. 1, 2004

(30) Foreign Application Priority Data

May 17, 2002 (MY) ..... PI 2002 1814

(51) Int. Cl.
*A47B 88/00* (2006.01)

(52) U.S. Cl. ..... 312/348.4; 312/265.5; 403/322.4; 403/325

(58) Field of Classification Search ..... 312/348.4, 312/348.1, 348.2, 263, 265.5; 403/321, 322.1, 403/322.4, 323, 325
See application file for complete search history.

(56) References Cited

U.S. PATENT DOCUMENTS 4,705,328 A * 11/1987 Rock et al. ..... 312/330.1
4,846,538 A * 7/1989 Rock et al. ..... 312/263
5,540,515 A * 7/1996 Rock et al. ..... 403/322.4
5,664,857 A * 9/1997 Lautenschlager et al. ..... 312/348.4
5,860,718 A * 1/1999 Brustle ..... 312/348.2
6,027,194 A * 2/2000 Fleisch ..... 312/348.4
6,179,399 B1 * 1/2001 Brustle et al. ..... 312/348.4
6,286,919 B1 * 9/2001 Fleisch ..... 312/348.4
6,457,791 B1 * 10/2002 Muterthies et al. ..... 312/348.4
2004/0000852 A1 1/2004 Lam Harn, et al.

FOREIGN PATENT DOCUMENTS

DE 3024972 1/1982
DE 3030199 3/1982
DE 298 09 494 * 11/1999
EP 289866 * 4/1988 ..... 312/348.4
EP 0740917 7/1994
EP 1297765 * 9/2002
GB 2193084 2/1988

* cited by examiner

*Primary Examiner*—Janet M. Wilkens
(74) *Attorney, Agent, or Firm*—Volpe and Koenig, P.C.

(57) ABSTRACT

A lock fitting arrangement for a knock down drawer for removably fastening the front panel of the drawer to side of the panels is presented. The lock fitting is made up of a holding plate having a mounting member and a fitting member. The mounting and fitting members are orthogonal to each other. A locking assembly with a housing and a spring-loaded lock is held in its unlocked position via a tapered step against a shoulder by a biasing spring, and a lever pivotably mounted within the housing to urge the lock for engaging the tapered step with the shoulder when desired. A locking projection is mounted on a second wall and cooperates with the lock to which it is removably attached to the first wall.

8 Claims, 7 Drawing Sheets

DRAWER FITTING ARRANGEMENT

FIELD OF INVENTION

The invention relates to a fitting arrangement for a knock down drawer more particularly to a lock fitting for fastening the front panel of said drawer to the side panels.

BACKGROUND OF THE INVENTION

Drawers insertable or in openings provided in articles or furniture have been known in the art.

Known drawers of the type under discussion include a bottom portion, two guide rails laterally engaged with the bottom portion, a front sheeting, a pair of parallel side portions, and a back portion extended between the rear ends of the side portions.

The side portions of the known drawers, disclosed, for example in German publication DE-OS No. 3024972; DE-OS No. 30 30199, formed of individual are components; such side portions and individual elements are manufactured so that eventually certain components are assembled to form left-hand side portions whereas the other certain components can be assembled only to form right-hand side portions of the drawer. An interchanging of the structural components to produce both side portions of the drawer had been impossible. Although efforts have been made to manufacture furniture drawers of plastics by spray molding to make each individual component in a single mold these efforts had resulted in very high costs. In as much as during the assembling of the individual component parts a user should pay attention as to which components belong to the right-hand side portion and which components should be taken into consideration for the left-hand side portion the whole assembling process has been time-consuming.

Although the fastening means for fastening the side portions to the front sheeting are covered with special caps in the known drawers the access to the fastening means in the assembled drawer for adjusting or removing the bolts has been difficult because it has been required to disassemble the drawer or at least to displace the component parts relative to each other to expose the fastening means. Moreover, it does not provide means for adjustment of front panel position once assembled for the purpose of correcting the alignment of the drawer.

SUMMARY OF THE INVENTION

It is an object of the present invention to provide an improved drawer lock fitting for article of furniture.

It is another object of the present invention to provide an improved metal drawer.

Due to the present invention the above indicated disadvantages of the conventional drawers for furniture can be avoided.

The drawer according to the invention is simple in construction and inexpensive in manufacture.

An easy access to the lock fitting in the drawer is ensured by the construction of the proposed drawer.

There is therefore provided a lock fittings for removably attaching a first wall to a second wall, said first and second walls being orthogonal to each other, said lock fittings comprising: a holding plate (6) having a mounting member (30) and a fitting member (26), said mounting (30) and fitting (26) members being orthogonal to each other; a locking assembly having a spring-loaded lock (8) and a housing (5) for housing said spring loaded lock (8), said lock (8) being held in the unlocked position by a tapered step (14) on said lock (8) against a shoulder (31) on said housing (5) by a biasing spring (10); said locking assembly being mounted on said fitting member (26) and forming a recess (46) there between; a lever having a pivot end (38) at one end, screw rounded end (45) the other, and a screw driver slot (39) proximate said rounded end (45), said lever being operable to urge said lock (8) against said spring (10) for engaging said lever (9); and a locking projection (48) attached to said second wall, part of said second wall for inserting into said recess (46), said locking projection (48) cooperating with said lock (8) for engaging with said projection (48), when said part of said second wall is fully inserted into said recess (46) and said lock (8) is released from said shoulder (31) and urged into the locked position by said spring (10); wherein said locking projection (48) and said second wall is removably attached to the said first wall by operating on said lever (9) with a screw driver engaging said screw driver slot (39) thereby urging said lock (8) against said spring (10) and engaging said step (14) with said shoulder (31).

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED EXPLANATION OF THE INVENTION

Figure 1:
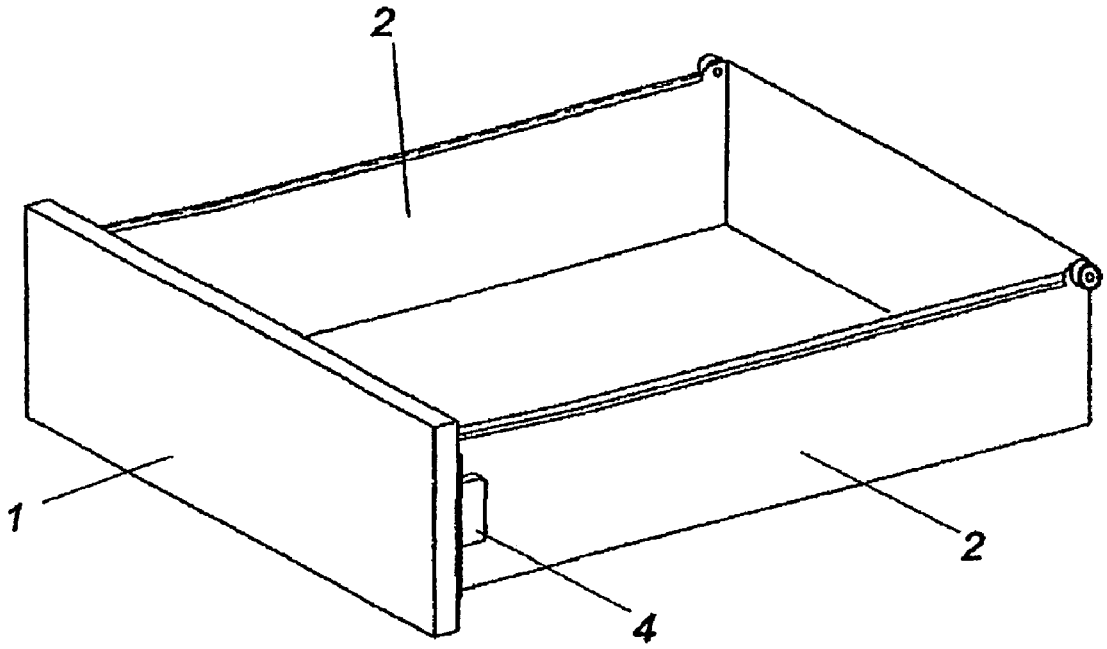
FIG. 1: Shows a perspective view of the steel drawer in assembly with the holding unit along with the front panel.

The fitting arrangement consists of a holding plate (6), a housing (5), a spring-loaded lock (8), a lever (9), an eccentric (7), a biasing spring (10) and a spring holder (19). After assembly of all the aforementioned parts, it is now referred to as the holding unit (4).

Figure 3:
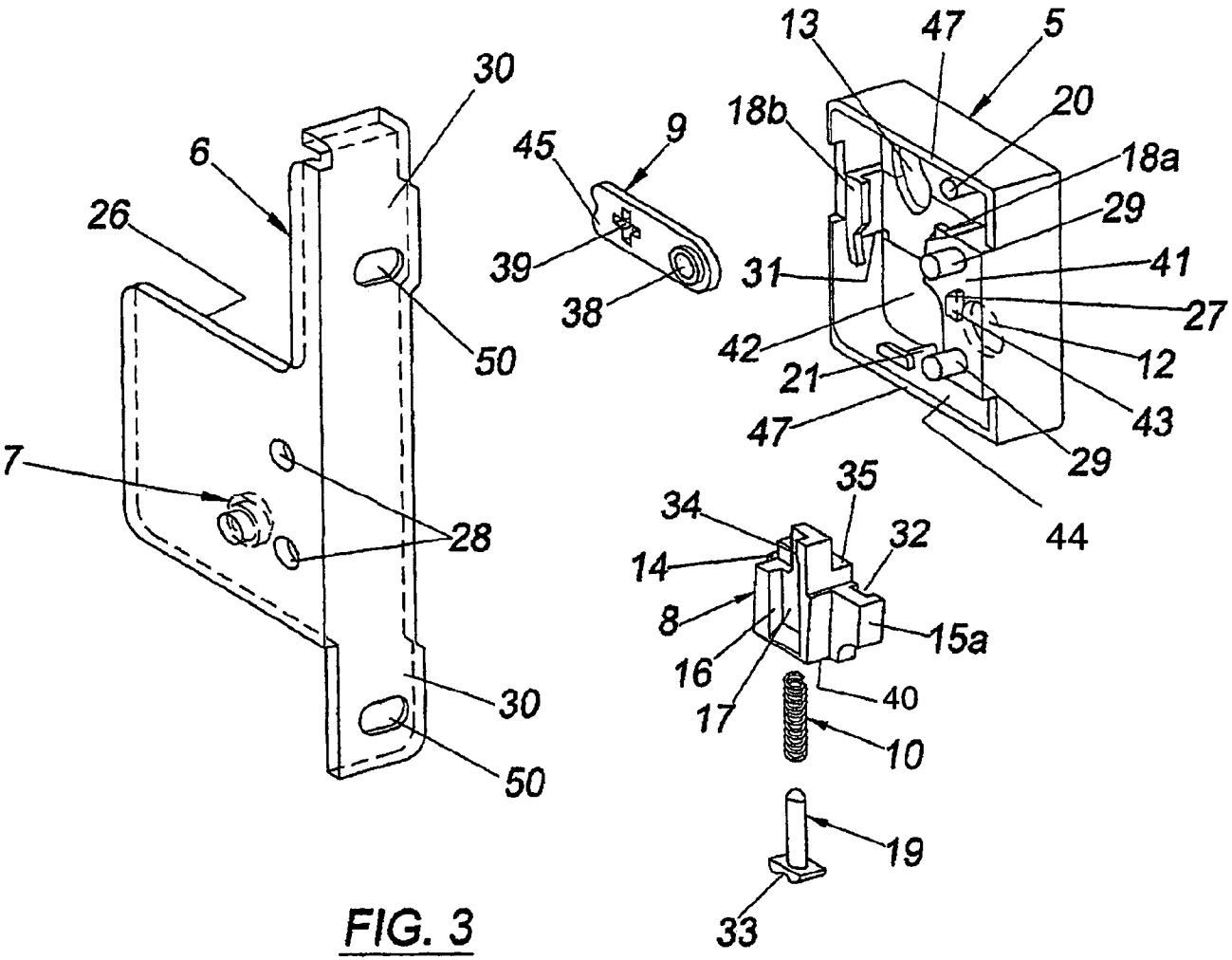
FIG. 3: Shows an exploded perspective view of the holding unit with details of the components involved and its functionally important features.
Figure 4:
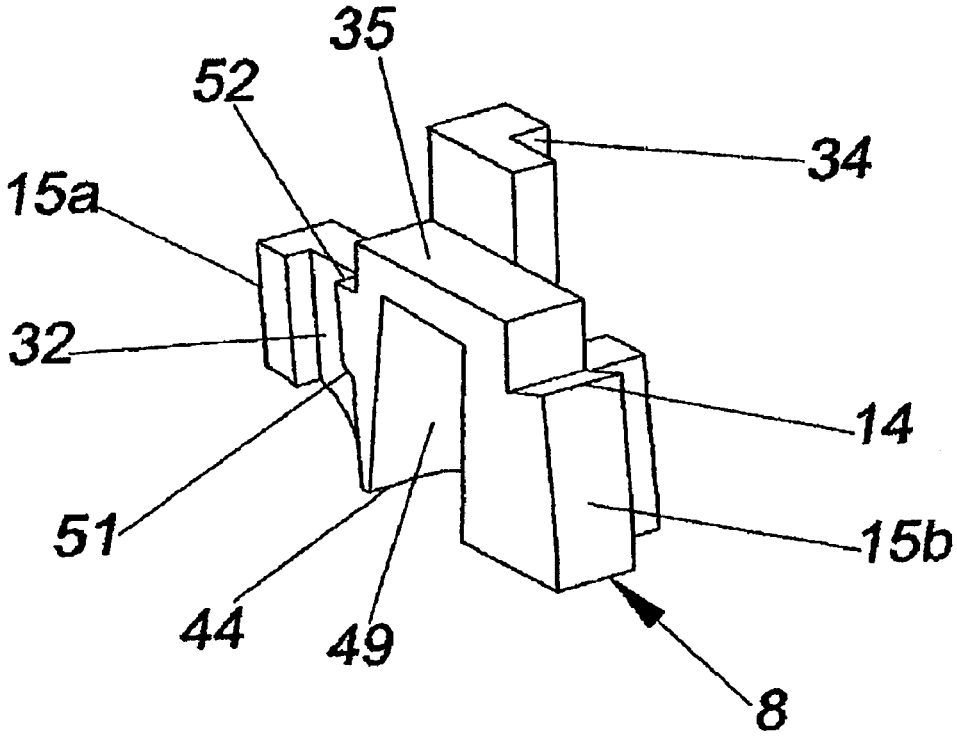
FIG. 4: Shows lateral view and a front view of the spring loaded lock before assembly.
Figure 4:
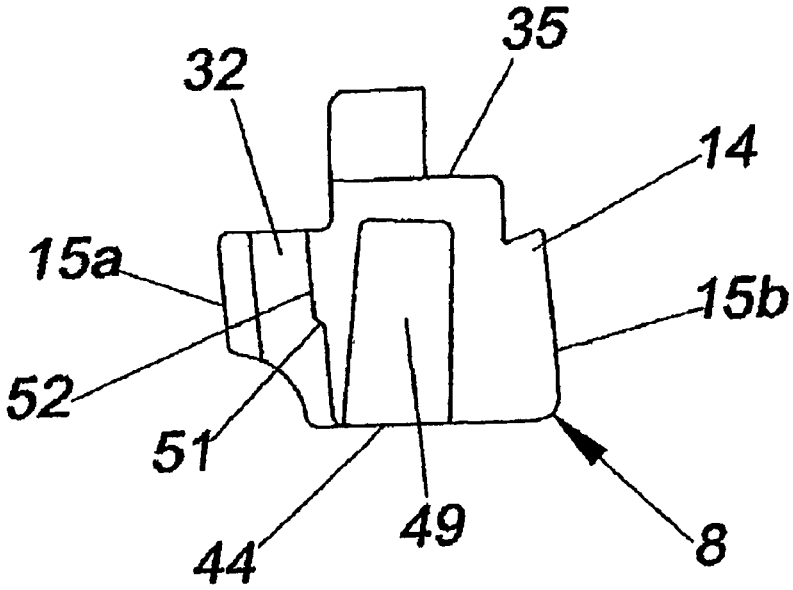

The holding plate (6) possesses a mounting member (30) and a fitting member (26) perpendicular to each other. The mounting member (30) has openings (50) in its surface top allow fastening to a first wall (1) of a drawer which is a front panel (1). The fitting member (26) of the holding plate (6) is provided with eccentric (7) and two openings (28) for fastening the housing (5) as shown in FIG. 3.

Figure 2:
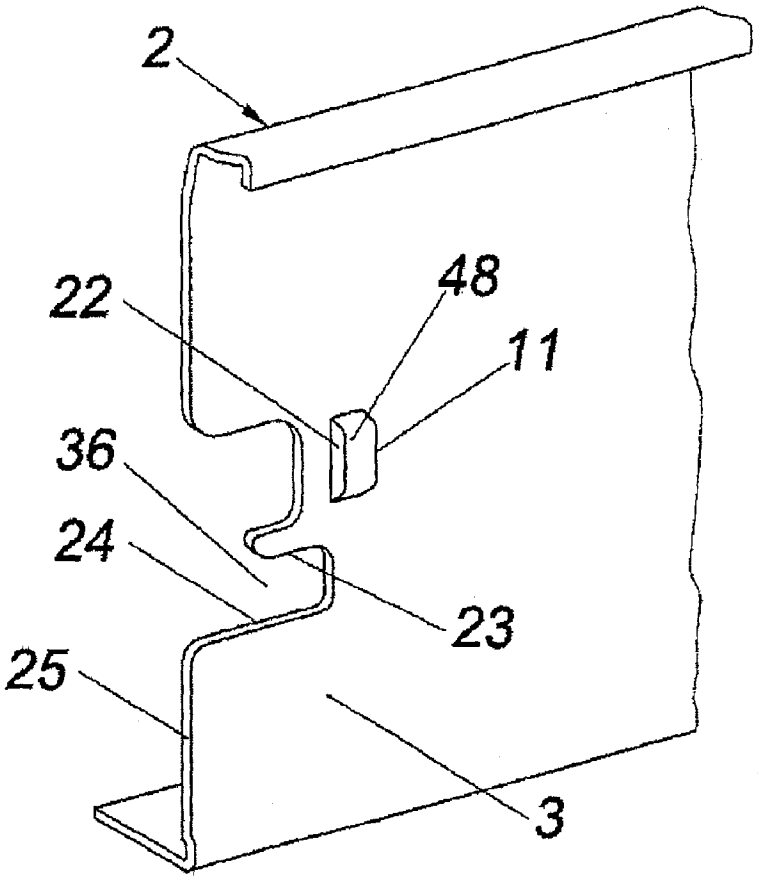
FIG. 2: Shows a perspective view of the holding unit and the side panel.
Figure 2:
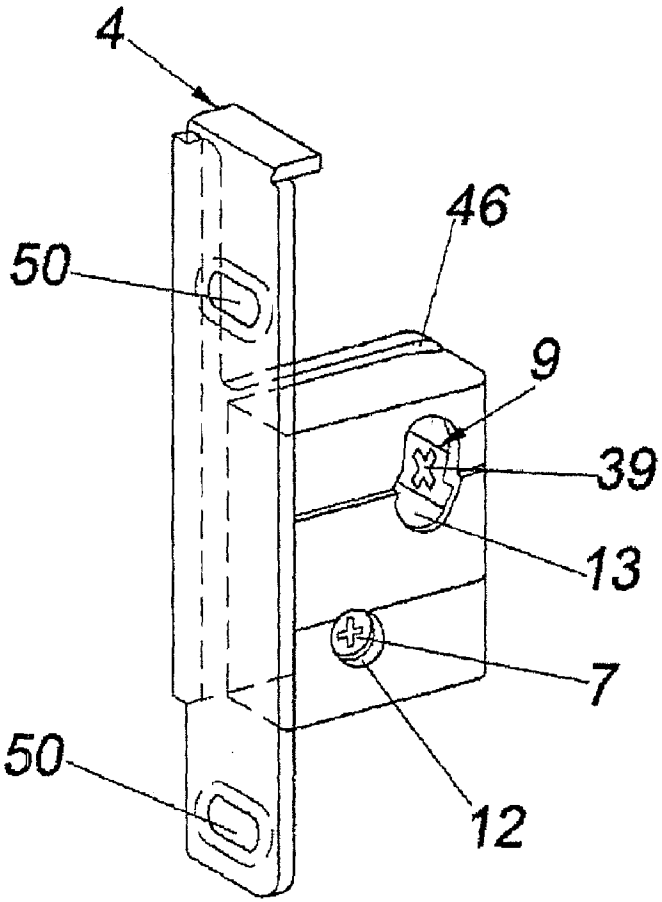

A second wall (2) of the drawer which is a side panel (2) has a vertical face (3) with a projection (48). The projection has two sides, namely a first projection side (11) and a second projection side (22). The vertical face (3) is provided with a recess (36) as shown in FIG. 2. This recess (36) has two parallel edges, namely a first recess edge (23) and a second recess edge (24). The side panel (2) is preferably a metal panel. The front face (25) of the side panel (2) is the edge of the vertical face (3).

A housing (5) serves as a housing for all the elements of the spring-loaded lock (8). The housing (5) is provided with a vertical face (41) and inner face (42). Two locators (29) are attached perpendicular to the vertical face (41). A pivot (20) is located perpendicular to the inner face (42) of the housing (5). A projection (43) with a stopper radius (27) is provided on the inner face 42) of the housing (5). A bottom face (44) perpendicular to the inner face (42) of the housing (5) is provided with a projection (21). Two guide members (18*a* & 18*b*) are attached at an angle (DO) to the inner face (42) of the housing (5) (refer to FIG. 3). This guide member (18*a*) is fastened in such a way that a shoulder (31) is formed by its edge. Two openings (12, 13) are provided on the inner face (42) of the housing (5). An edge face (47) is provided around the inner face (42) is the housing (5) and parallel to the vertical face (41) of the housing (5).

The spring-loaded lock (8) is provided with a locking face (17), and a groove (32) parallel to and on the reverse side of the locking face (17). An angular step is (51) is provided on the guiding side (52) of the groove (32) of the spring-loaded lock (8). A clamping face (16) is provided on the spring-loaded lock (8) perpendicular to the locking face (17). Two angular collars (15*a* & 15*b*) parallel to each other are provided on both sides of the locking face (17) at an angle with respect to the clamping face (16). A tilt face (34) perpendicular to the locking (17) and parallel to the clamping face (16) is provided on the spring-loaded lock (8). A recess (49) is provided behind the locking face (17) from the bottom face (40) of the spring-loaded lock (8) for locating the biasing spring (10). A tapered edge (14) is provided at the edge of an angular collar (15*b*) and perpendicular to the locking face (17) the spring-loaded lock (8). An upper face (35) is provided perpendicular to the locking face (17) of the spring-loaded lock (8).

The lever (9) has a pivot opening (38) and an adjustable slot (39). Adjacent to the pivot opening (38), a rounded end (45) is provided on the lever (9). This lever (9) is fastened in the housing (5) by inserting the pivot opening (38) on a pivot (20) inside the housing (5). This lever (9) can be rotated along the center of the pivot (20) by inserting a screwdriver through an opening (13) on the housing (5) into the screwdriver slot (39) of the lever (9).

The spring-loaded lock (8) is slid inside the guide member (18*a* & 8*b*) of the housing (5). The angular collars (15*a* & 15*b*) then guide the spring-loaded loak (8). A biasing spring (10) is inserted through the bottom face (40) of the spring-loaded lock (8) inside a recess (49). This prevents the biasing spring (10) from slipping when the spring-loaded lock (8) is pushed down. A spring holder (19) is inserted inside the inner surface of the biasing spring (10). The curved profile (33) of the spring holder (19) rests on the projection (21) on the bottom face (44) of the housing (5).

Figure 6:
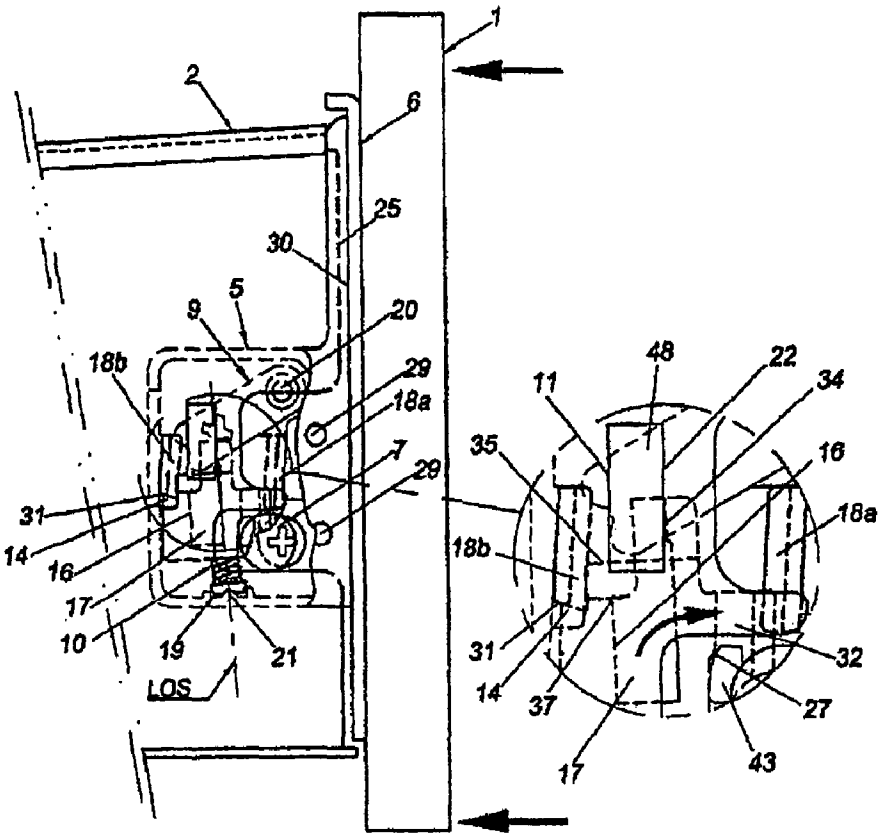
FIGS. 5 & 6: Shows a lateral view of the holding unit on the front panel and the side panel as they are assembled.
Figure 5:
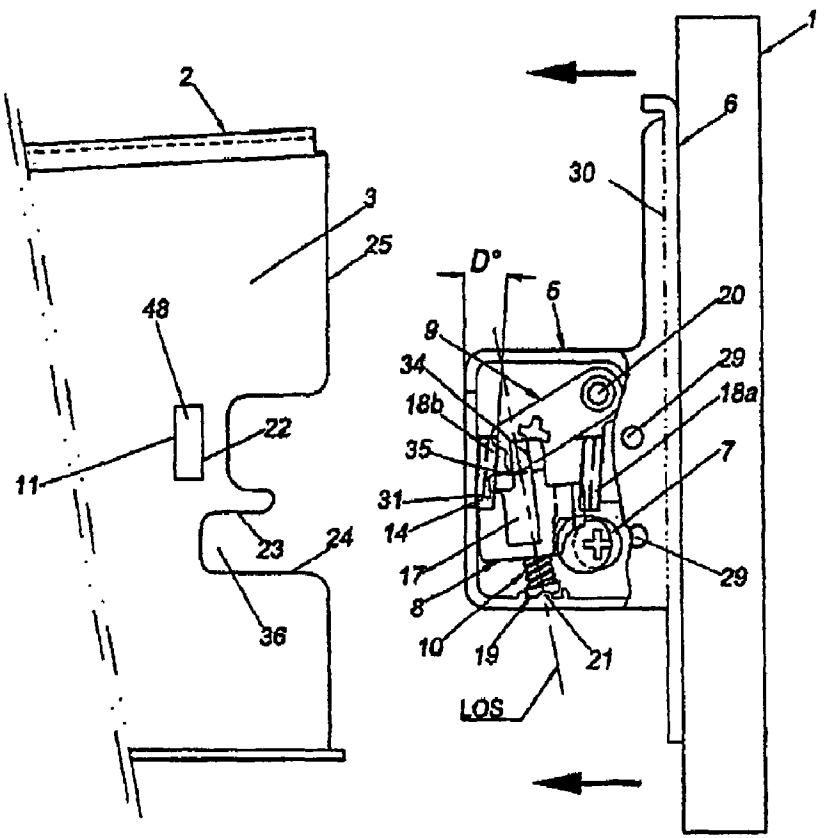
Figure 7:
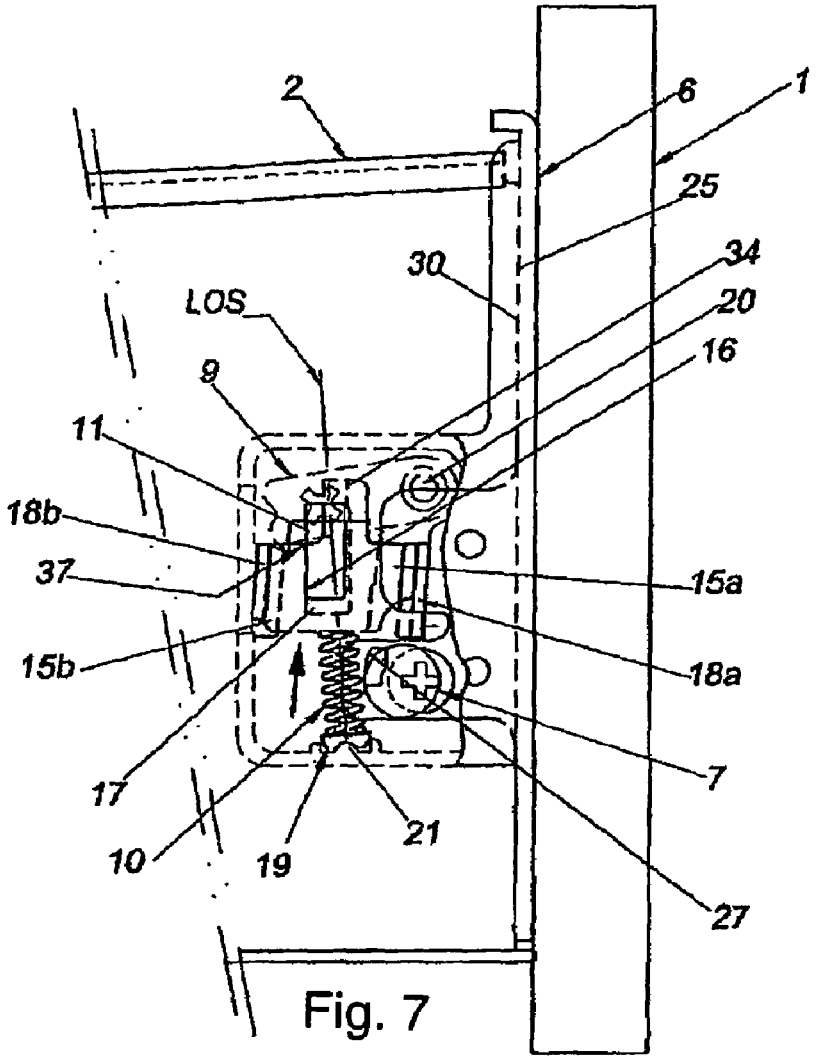
FIG. 7: Shows a cross-sectional view of the holding unit and side panel in assembly.
Figure 8:
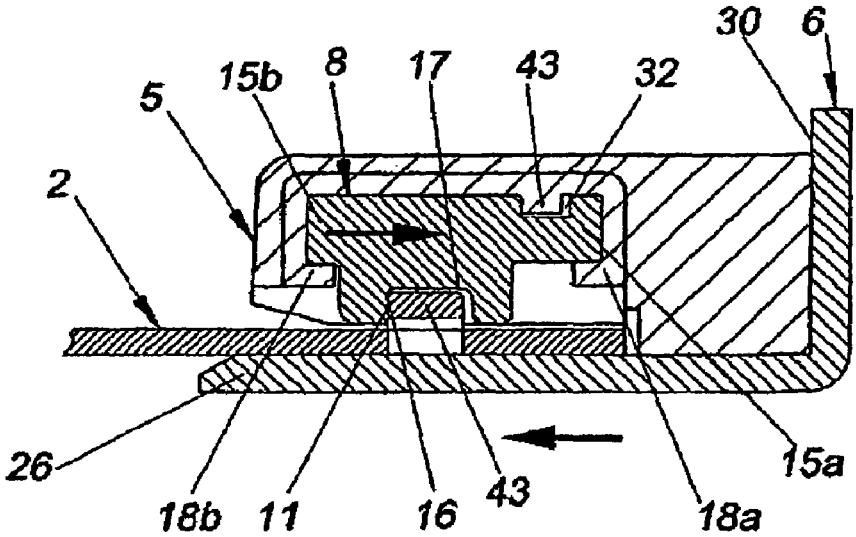
FIGS. 8 & 9: Shows the lateral view of the holding unit and the side panel as they are dismantled.

This whole assembly is referred to as a holding unit (4). The holding unit (4) is fastened to the front panel of the drawer (1) by the openings (50) on the vertical mounting member (30) of the holding plate (6). The holding unit (4) with the front panel (1) is inserted on the vertical face (3) side panel (2) through guide recess (46) (refer to FIGS. 5 & 6). When the holding unit (4) is pushed inside, the tilt face (34) thrusts against the secong projection-side (22) of the projection (48). This compels the tapered edge (14) to tilt of the spring-loaded lock (8) and come out of the shoulder (31) of the housing (5). When the tapered edge (14) of the spring-loaded lock (8) releases from the shoulder (31), the holding unit (4) with the front panel (1) simultaneously moves inside the vertical face (3) of the side panel (2).

When the spring-loaded lock (8) releases from the shoulder (31) of the housing (5) and the biasing spring (10) pushes it upward through the guide member (18*a* & 18*b*) which is at an angle (D.div.). This angle (D.div.) causes the spring-loaded lock (8) to move at an angle so that the clamping face (16) of the spring-loaded lock (8) gradually slides over the first projection side (11) of the projection (48) on the side panel (2) and clamps the side panel (2) against the holding unit (4) and front (1). When the front panel (1) is held rigidly against the side panel (2) by the holding unit (4), the clamping face (16) of the spring-loaded lock (8) is in full contact with the first projection side (11) and the front face (25) is fully in contact with the front panel (1) without any clearance. The positive clamping of the side panel (2) against the holding unit (4) and front panel (1) is attained angular movement of the spring-loaded lock (8).

When the front panel (1) is held against the side panel (2) on both sides of the drawer, the alignment of the front panel (1) is adjusted by rotating the eccentric (7) on the holding plate (6). Inserting a screwdriver through the opening (12) of the housing (5) rotates the eccentric (7). The front panel (1) can be moved up and down by the radial motion of the outer surface of the eccentric (7) inside the recess (36).

Figure 9:
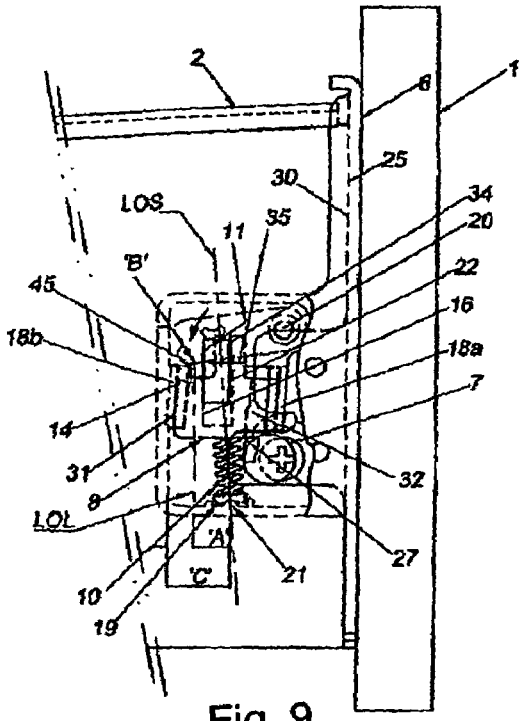

The front panel (1) can be removed from the side panel (2) of the drawer by inserting the screwdriver into the screwdriver slot (39) through the opening (13) of the housing (5) when the lever (9) is rotated, it pushes down on the spring-loaded lock (8). The point of contact 'B' of the lever (9) on the spring-loaded lock (8) and the projection (21) on the housing (5) where the spring holder(19) is located is offset at a particular distance. This offset causes the spring-load lock (8) to tilt towards the shoulder (31) with the lever (9) is pushing it downwards. The line of action (LOS) of the biasing spring (10) and the line of action (LOL) of the lever (9) is offset in such a way that the horizontal distance 'A' of point of contact 'B' is nearer to the shoulder (31) the horizontal distance 'c' of the projection (21) on the bottom face (44) of the spring-load lock (8) is greater than the distance 'A' (refer to FIG. 9). The offsetting compels the biasing spring to (10) to push the tapered edge (14) of the spring-loaded lock (8) over the shoulder (31) of the housing (5). The spring-loaded lock (8) is guided by the guide member (18*a* & 18*b*) housing (5) at an angle (D.div.)

Figure 10:
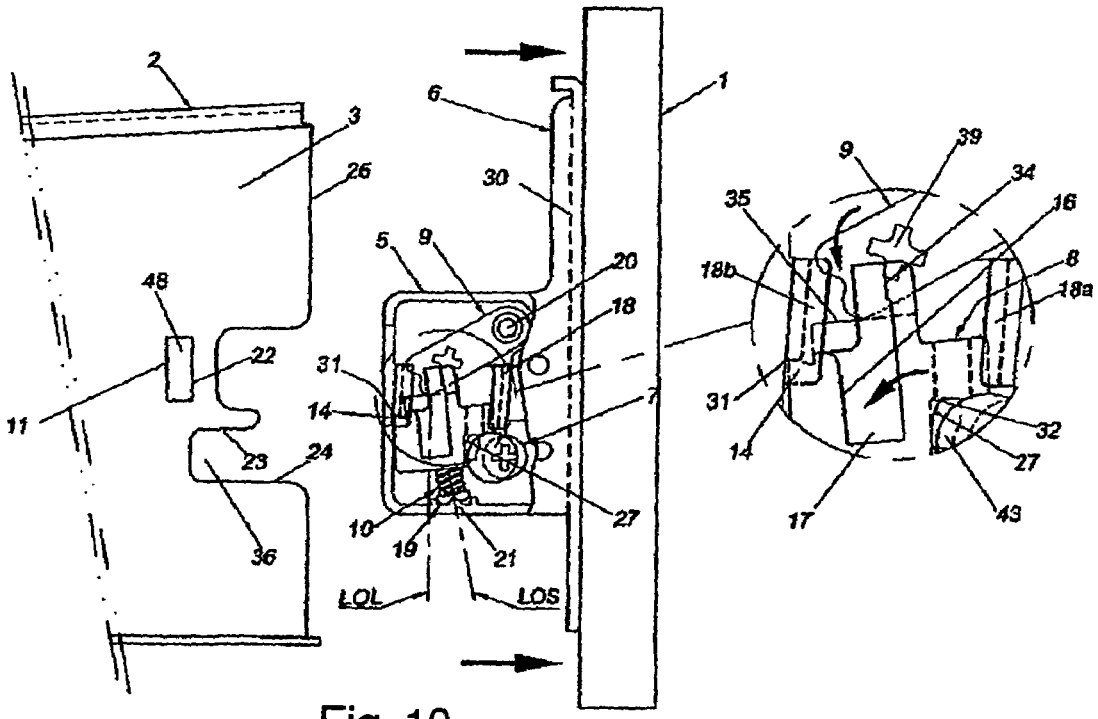
FIG. 10: Shows a lateral view of the side panel and the holding unit in its unlocked position.

When the spring-loaded lock (8) tilts down an at angle towards the shoulder (31) at the same time that the biasing spring (10) pushes the spring-loaded lock (8) upwards. When the spring-loaded lock (8) moves downwards, the projection (43) is guided by the guiding side (52) on the groove (32) of the spring-loaded lock (8). The spring-loaded lock (8) tilts at a point where the angular step (51) on the guiding side (52) of the spring-loaded lock (8) comes into contact with the stopper radius (27) on the projection (43) the cover of 10 housing (5) (refer to FIG. 10).

Further rotation of the lever (9) makes the spring-loaded lock (8) tilt more and the tapered step (14) of the spring-loaded lock (8) slides out of the guide member (18*b*) and moves inside the shoulder (31) because of the potential of the spring, and then gets locked in that position. The shape of the opening (13), which allows the screwdriver to rotate a limited distance, limits rotation of lever (9). This causes the lever (9) to push the spring-loaded lock (8) just enough to rotate slightly. This makes the lever (9) compel the spring-loaded lock (8) just enough lock the shoulder (31) of the housing (5) (refer FIGS. 9 & 10). The holding unit (4) along with the front panel (1) can be detached from the side panel in this position.

What is claimed is:

1. A lock fitting comprising:

a holding plate (4) with a mounting member (30) and a fitting member (26), whereby said mounting (30) and fitting (26) members are attached perpendicular to each other and said holding plate (4) is attached to a first wall (1);

a locking assembly with a housing (5) and a spring-loaded lock (8) mounted within said housing (5), said spring-loaded lock (8) being held an unlocked position via a tapered step (14) on said spring-loaded lock (8) against a shoulder (31) on said housing (5) by a biasing spring (10); whereby said locking assembly being mounted on said fitting member (26) of said holding plate (4) and forming a recess (46) there between;

a lever having a pivot opening (38) at one end and an adjustable slot (39), pivotably mounted within said housing (5) and being in contact (B) with said spring-loaded lock (8) to urge said spring-loaded lock (8) against said biasing spring (10) for engaging said tapered step (14) with said shoulder (31) when desired; and a locking projection (48) located adjacent a second wall (2), cooperating with said spring-loaded lock (8) to which said second wall (2) is removably attached, said second wall (2) is inserted perpendicularly into said recess (46) and said tapered step (14) is released from said shoulder (31) and urged into a locked position by said biasing spring (10).

2. The lock fittings according to claim 1, wherein said spring-loaded lock (8) has locking face (17) for slidable engagement with said locking projection (48).

3. The lock fittings according to claim 2, wherein said spring-loaded lock (8) has a pair of angular collars (15*a*,15*b*) on the respective sides of said locking face (17).

4. The lock fittings according to claim 3, wherein said housing (5) has a pair of guide members (18*a*,18*b*) for engaging with said pair of angular collars (15*a*,15*b*) when said spring-loaded lock (8) is mounted within said housing (5).

5. The lock fittings according to claim 4, wherein the surfaces of said pair of guides (18*a*,18*b*) are inclined towards said mounting member (30) at an angle (D) from the vertical axis.

6. The lock fittings according to claim 4, wherein said pair of angular collars (15*a*,15*b*) have clearances with said guide members (18*a*,18*b*) for allowing said spring-loaded lock (8) to rotate therein.

7. The lock fittings according to claim 1, wherein said biasing spring (10) having its line of action offset from said point of contact (B) and said spring-loaded lock (8) is tilted towards said mounting member (30) of said holding plate (4) when said lever (9) is rotated and pushed down.

8. The lock fitting according to claim 7, wherein said lever (9) having its line of action offset in such a way that a horizontal distance of point of contact of said lever (9) and said spring-loaded lock (8) is nearer to said shoulder (31).

* * * * *

UNITED STATES PATENT AND TRADEMARK OFFICE

CERTIFICATE OF CORRECTION

PATENT NO. : 7,055,919 B2
APPLICATION NO. : 10/440424
DATED : June 6, 2006
INVENTOR(S) : Lam et al.

It is certified that error appears in the above-identified patent and that said Letters Patent is hereby corrected as shown below:

ON THE TITLE PAGE:

At item (75), delete the inventor name “Lian Lam Harn”, and insert therefor --LAM, Harn Lian--.

At item (75), delete the inventor name “Yan Lam Harn”, and insert therefor --LAM, Harn Yan--.

At column 1, line 60, after the word “lock”, delete “fittings” and insert therefor --fitting--.

At column 2, line 33, after the word “the”, delete “steel”.

At column 2, line 64, after the words “provided with”, insert --the--.

At column 3, line 33, after the word “locking”, insert therefor --face--.

At column 4, line 50, after the word “down”, delete the words “an at”, and insert therefor --at an--.

In Claim 1, at column 5, line 8, after the word “plate”, delete the reference numeral “(4)”, and insert therefor --(6)--.

In Claim 1, at column 5, line 11, after the word “plate”, delete the reference numeral “(4)”, and insert therefor --(6)--.

In Claim 1, at column 5, line 15, after the word “held”, insert --in--.

In Claim 1, at column 5, line 19, after the word “plate”, delete the reference numeral “(4)”, and insert therefor --(6)--.

In Claim 3, at column 6, line 4, after the word “lock”, delete “fittings” and insert therefor --fitting--.

In Claim 4, at column 6, line 7, after the word “lock”, delete “fittings” and insert therefor --fitting--.

In Claim 5, at column 6, line 12, after the word “lock”, delete “fittings” and insert therefor --fitting--.

UNITED STATES PATENT AND TRADEMARK OFFICE

CERTIFICATE OF CORRECTION

PATENT NO. : 7,055,919 B2
APPLICATION NO. : 10/440424
DATED : June 6, 2006
INVENTOR(S) : Lam et al.

It is certified that error appears in the above-identified patent and that said Letters Patent is hereby corrected as shown below:

In Claim 5, at Column 6, line 13, after the words "pair of", delete "guides", and insert therefor --guide members--.

In Claim 6, at column 6, line 16, after the word "lock", delete "fittings" and insert therefor --fitting--.

In Claim 7, at column 6, line 20, after the word "lock", delete "fittings" and insert therefor --fitting--.

In Claim 7, at column 6, line 23, after the word "plate", delete the reference numeral "(4)", and insert therefor --(6)--.

Signed and Sealed this

Twenty-second Day of May, 2007

JON W. DUDAS
*Director of the United States Patent and Trademark Office*